United States Patent [19]

Campbell

[11] 4,440,864

[45] Apr. 3, 1984

[54] CHEMICALLY BONDABLE FOUNDRY SAND

[75] Inventor: John Campbell, Worcester, England

[73] Assignee: Cosworth Research and Development Limited, Worcester, England

[21] Appl. No.: 359,923

[22] Filed: Mar. 19, 1982

[30] Foreign Application Priority Data

Apr. 1, 1981 [GB] United Kingdom ..... 8110234

[51] Int. Cl.[3] ..... C04B 35/80

[52] U.S. Cl. ..... 501/95; 106/38.2; 106/38.3; 106/38.35

[58] Field of Search ..... 501/95; 106/38.3, 84, 106/80, 81, 38.2, 38.35

[56] References Cited

U.S. PATENT DOCUMENTS

| | | | |
|---|---|---|---|
| 2,876,511 | 3/1959 | Baugh | 106/38.3 |
| 3,442,665 | 5/1969 | Muller et al. | 106/38.3 |
| 4,208,214 | 6/1980 | Stein et al. | 501/95 |

FOREIGN PATENT DOCUMENTS

| | | | |
|---|---|---|---|
| 1380442 | 1/1975 | United Kingdom | 501/95 |
| 1480589 | 7/1977 | United Kingdom | 501/95 |

*Primary Examiner*—James Poer

*Attorney, Agent, or Firm*—Vaden, Eickenroht, Thompson, Bednar & Jamison

[57] ABSTRACT

A chemically bondable foundry sand comprising a mixture of sand, binder and a plurality of fibres intimately mixed and dispersed throughout the mixture. Cores and moulds made from such sand have improved fracture resistance. The mixture may comprise from 0.01 to 1.0 wt. % of fibres, the length/diameter ratio of each fibre may be at least 10 and the fibres may have a length of from 1 to 20 mm. The fibres may be glass fibres, organic fibres or natural fibres. The binder may comprise a silicate binder or an organic binder such as a phenolic binder or a furane binder.

7 Claims, No Drawings

CHEMICALLY BONDABLE FOUNDRY SAND

BACKGROUND OF THE INVENTION

1. Field of the Invention

This invention relates to a chemically bondable foundry sand comprising a mixture of sand and binder. The term foundry sand is intended to relate to granular material from which moulds and cores are made, for example, silica sand, zircon sand, chromite sand, olivine sand, silicon carbide in granular form, iron and steel shot, salt (sodium chloride in dry granular form), chamotte (and other aluminosilicate type granulated products), and all such granular material is referred to herein as foundry sand.

2. Description of the Prior Art

There are available today two main types of chemical binder systems for foundry sand. One of the two main types is a silicate binder such as sodium silicate which whilst having good environmental properties is not easily reclaimable and does not break down well after casting so that cores are difficult to remove. The other main type is constituted by organic resins, including phenolic and furane types. These are generally less pleasant to handle and are often rather more costly than those of the first type but have the advantage that they break down significantly on casting, making de-coring easy, and are relatively easily reclaimed by various methods in which the remaining resin is either abraded or burned off the sand grains.

All these binders are mixed with clean, or washed sand, and are caused to harden, either by heat or chemical reaction with a gas or other chemical additive to the mixture, so forming a strong mould or core.

Naturally, strength depends on the amount of binder but the amount is restricted by foundry technologists in an effort to reduce costs; reduce striking to patternwork; reduce contraction resistance of the casting, so reducing hot tearing problems, and improve knock-out.

Thus, strength is generally reduced to a minimum level at which the regular breakage of cores becomes a significant problem. This involves extra cost in the core since many cores never reach the mould in one piece and involves even more expense if breakage occurs in the mould during or after closure, or during casting.

Although chemical binder systems have now been used by the foundry industry for over two decades, there has been no good solution to the above problem. The usual practice has been to resort to wires or nails which have to be laid by hand into the core during manufacture, precluding the use of automatic core blowing machines.

It is accordingly an object of the present invention to provide a chemically bondable foundry sand whereby the above mentioned problems are overcome or are reduced.

SUMMARY OF THE INVENTION

According to the present invention we provide a chemically bondable foundry sand comprising a mixture of sand, binder and a plurality of fibres intimately mixed and dispersed throughout the mixture.

The fibres provide the resultant hardened mould or core with a substantial resistance to failure by fracture.

The mixture may comprise from 0.01 to 1.0 wt.% of fibres and preferably from 0.01 to 0.4 wt.% and still more preferably from 0.05 to 0.3 wt.%.

The length/diameter ratio of each fibre is at least 10 and preferably in the range 100:1 to 1,000:1.

The fibres may have a length of from 1 and 20 mm and preferably from 6 mm to 14 mm.

The fibres may comprise glass fibres, which provide excellent resistance to fracture but glass fibres have the disadvantage that they do not degrade on casing nor on thermal reclamation and therefore become a source of pollution in the sand mixture.

Organic fibres are therefore preferred because of their properties in avoiding knock-out and thermal reclamation problems.

The fibres may comprise Nylon fibres but these fibres have the disadvantage of not bonding well to the fibre surface allowing failure to occur by pulling out of the fibres.

It has been found preferable to utilise polypropylene fibres, polyvinyl alcohol fibres and poly ester fibres which have the advantage that they are conveniently commercially available in large quantities in a form chopped to the desired length. The polypropylene fibres may be at least partly fibrilated.

Alternatively the fibre may comprise other synthetic organic fibres such as Nylon, Rayon, which have the advantages of being highly reproducible in their properties and being clean and free from many health hazards.

Alternatively the fibre may comprise carbon fibres, such fibres have the disadvantage of being relatively expensive at the present time and very brittle and difficult to use.

Alternatively the fibres may comprise natural fibres such as, for example, hemp, sisal, copra, cotton, flax, alfalfa, straw, wool, horsehair, woods of various kinds including bamboo etc.

The fibres and sand and binder are mixed by utilising either batch mixers or continuous mixers of conventional type. Where a continuous mixer is used it is possible to achieve accurate metering of the fibres by incorporating a chopping device which will accept rovings of the fibres and cut this to the desired lengths at a controlled rate to give the desired proportion of fibre to the mixture.

Where the chemical binder is a silicate binder, from 2 to 5 vol.%, and where the binder is a phenolic binder from 2 to 5 vol.% and where the binder is a furane binder, from 1 to 2.7 vol.% of binder may be present.

DESCRIPTION OF THE PREFERRED EMBODIMENTS

In a first example, silica sand of an average grain size of 244 μm bonded with a furane polymer resin had polyvinyl alcohol fibre mixed in. The fibres were 6 mm long and 1.6 denier (13 μm) in diameter. It was found that the energy of fracture increased from 39 without fibres, to 69 Joules/m$^2$ with 0.2 wt.% fibre content.

In a second example, the said silica sand was mixed with polyester fibres 6 mm long and 3 denier (about 17 μm) diameter. The energy of fracture increased steadily from 51 to 130 Joules/m$^2$ as the percentage of fibres increased from zero to 0.2 wt.%. At this level of addition with this length of fibre, the mixture was nearing the maximum level of addition which would allow the mixture to be moulded into cores (higher addition levels are possible with shorter fibres, although it is found that under all conditions investigated, 1 wt.% of addition generally represents a maximum beyond which the mixture is not mouldable by normal core making techniques of blowing or hand filling). At 0.02 wt.% addition the benefit was a hardly measurable rise of about 4% in the energy to fracture. Thus it is considered that the 0.01 to 0.02 wt.% addition level represent a lower boundary beneath which the benefits of the process become negligible, and we have found that at about 0.05 wt.% in most systems and under most conditions the effects are becoming significantly beneficial.

In a third example, the said silica sand was mixed with 1 wt.% UF/FA resin and 0.1 wt.% polyester fibres of approximately 17 μm diameter of various lengths increasing from zero to 14 mm. At zero length the fracture energy was 49 Joules/$m^2$. This increased steadily to 120 Joules/$m^2$ at 8 mm length, but thereafter was roughly constant with further length increase up to 14 mm.

In a fourth example, zircon sand of 85AFS was bonded with a furane polymer resin and had glass fibres incorporated in the mixture, the fibres being 10 mm long and having diameters lying in the range 1–50 μm. It was found that the mixture had excellent resistance to fracture when containing between 0.2–0.3 wt.% of fibres.

In a fifth example, Nylon fibres of 10 mm length and 50 μm diameter were found to provide good resistance to fracture when present in amounts lying in the range 0.1–0.4 wt.%. The resistance to fracture was not as high as would be expcted from the strength of the Nylon fibres themselves since it was found that the binder resin did not bond well to the fibre surface allowing the failure to occur by pulling out of the fibres.

It has been found that the strength of some mixtures embodying the present invention for a given binder content is reduced when the mixture contains a high fibre content such as in the range 0.4 to 1.0 wt.% when tested on conventional sand testing equipment.

It is thought to be the result of the binder resin being spread more thinly as a result of the extra area resulting from the presence of the fibres and, possibly, as a result of slightly less dense packing of the sand grains. However, although the ultimate breaking stress of the core is reduced, the energy to separate the core into pieces is still considerably enhanced. Effectively, after fracture, the sand requires a further elongation to total failure.

Thus, even at high levels of addition where strength is reduced, the use of fibre strengthening of cores and moulds will keep the sand shape intact despite failure by cracking; if a core or mould cracks, it is still often perfectly usable and safe and will not lead to a casting defect. Generally, the worst that happens in the case of a severe crack is a thin metal flash but the core or mould surfaces on either side of the crack will generally stay in register and it is merely necessary to remove the flash during a simple fettling operation. Even if cracking occurs during handling it can be repaired.

In addition, the use of organic fibres to reinforce silicate bonded sands should improve thermal breakdown of such sands.

The present invention provides a chemically bondable foundry sand which results in a strong, handleable core or mould effectively unbreakable prior to and during casting but which will break down on casting and thereby facilitating de-coring.

I claim:

1. A chemically bondable reclaimable foundry sand mixture for fabricating cores or moulds used in metal castings consisting essentially of a granular mixture of sand, organic resin binder and a plurality of organic fibres intimately mixed and dispersed throughout the mixture and which fibres increase resistance to fracture and breakage of cores or moulds used in metal castings, whereby a core or mould prepared from said sand mixture is physically strong and handleable and relatively unbreakable during metal casting but which core or mould is easily reclaimed from said sand mixture by resin burn-off procedures.

2. A sand mixture according to claim 1 wherein the mixture comprises from 0.01 to 1.0 wt.% of fibers.

3. A sand mixture according to claim 1 wherein the length/diameter ratio of each fiber is at least 10.

4. A sand mixture according to claim 1 wherein the fibers have a length of from 1 to 20 mm.

5. A sand mixture according to claim 1 wherein the fibers are selected from the group comprising polypropylene fiber, polyvinyl alcohol fiber and polyester fiber.

6. A sand mixture according to claim 1 wherein the fibers comprise natural fibers.

7. A sand mixture according to claim 1 wherein the organic resin binder is selected from the group comprising a phenolic binder or a furane binder.

* * * * *